US006484498B1

(12) United States Patent
Bonar, II

(10) Patent No.: US 6,484,498 B1
(45) Date of Patent: Nov. 26, 2002

(54) APPARATUS AND METHOD FOR CONVERTING THERMAL TO ELECTRICAL ENERGY

(76) Inventor: Henry B. Bonar, II, 4939 Morven Rd., Jacksonville, FL (US) 32210

( * ) Notice: Subject to any disclaimer, the term of this patent is extended or adjusted under 35 U.S.C. 154(b) by 0 days.

(21) Appl. No.: 09/872,807

(22) Filed: Jun. 4, 2001

(51) Int. Cl.[7] ..... F01B 29/10

(52) U.S. Cl. ..... 60/517; 60/516; 60/508

(58) Field of Search ..... 60/508, 516, 517, 60/520

(56) References Cited

U.S. PATENT DOCUMENTS 4,306,414 A * 12/1981 Kuhns ..... 60/510
4,454,426 A * 6/1984 Benson ..... 290/1 R
4,458,489 A * 7/1984 Walsh ..... 60/520
4,841,732 A * 6/1989 Sarcia ..... 62/36
5,461,859 A * 10/1995 Beale et al. ..... 60/517

* cited by examiner

*Primary Examiner*—Hoang Nguyen
(74) *Attorney, Agent, or Firm*—Arthur G. Yeager

(57) ABSTRACT

A cycle engine. converting thermal energy to electricity includes a cylinder housing having a piston having two oppositely disposed heads and mounted for reciprocating inside the cylinder. The cylinder is disposed between a hot zone to supply hot gas to one piston head and a cold zone to receive discharged hot gas from another piston head, and to transform the discharged hot gas into a liquid. The hot zone supplies hot gas into the first piston head, while the second head discharges hot gas to the cold zone. This action creates a pressure differential between the two piston heads that causes the piston heads to move in one direction. Thereafter, the hot zone supplies hot gas to the second piston head, while the first piston head discharges hot gas to the cold zone, thereby creating pressure differential between the heads causing the piston to move in another direction. The piston is provided with a permanent magnet coupled to electric coil. When the piston reciprocates, it creates a magnetic influx in the electric coil, which is transformed into electricity in the coil.

33 Claims, 2 Drawing Sheets

APPARATUS AND METHOD FOR CONVERTING THERMAL TO ELECTRICAL ENERGY

CROSS REFERENCE TO RELATED APPLICATION

Not applicable.

STATEMENT REGARDING SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a cycle engine, and more particularly, to a modified cycle engine utilizing thermal energy to reciprocate a piston to generate electricity.

2. Related Art

A well known cycle engine is a reciprocating heat engine that operates by transferring heat from an external source into a gaseous fluid sealed within the piston's cylinder. The fluid undergoes closed cycle of heating, expansion, cooling and compression, alternating back and forth through thermal storage regenerators. Characteristic of theses engines is the requirement that there be a number of rotating parts, ports, flywheels:, turbine blades, load-bearing and lubricating parts. The relatively large number of parts increases the possibility of malfunction, while seals and bearings are subject to wear ,land require lubrication. Frequent wearing of these parts effects reliability of cycle engines.

It is apparent that there is a need for new and improved cycle engines, which are mechanically uncomplicated, and economical to produce on a large scale. There is a need for greatly simplified mechanical arrangements with a minimum number of moving parts to enhance reliability of cycle engines.

Accordingly, it is a primary object of the present invention to provide for simplified cycle engines with minimum moving parts.

It is another object of the invention to provide for an exceptionally quite and reliable operation of such engines within a cylinder housing disposed between a hot zone and a cold zone.

It is another object of the invention to provide for a unique piston arrangement utilizing thermal energy.

It is a further object of the invention to provide for a cycle engine having high degree of reliability.

It is another object of the invention to provide for a piston mechanical arrangements having opposed piston heads whereby the traditional use of cranks, connecting rods, swash plates, cams and other components normally used with pistons are eliminated.

It is still another object of the invention to provide for a double-headed piston whereby hot gas is supplied to one head while hot gas is discharged from the other head thereby causing pressure difference to reciprocate the piston.

Yet, it is another object of the invention to provide for a cycle engine wherein thermal energy is transformed into a pressure difference inside a piston causing the piston to reciprocate to ultimately generate electricity.

BRIEF SUMMARY OF THE INVENTION

The present invention relates to a cycle engine utilizing thermal energy to provide high pressure gas, which is supplied to a first piston conduit while gas is discharged from a spatially distanced second piston conduit thereby creating pressure differential therein causing the piston to move in one direction. Hot gas is supplied to the second conduit while gas is discharged from the first conduit thereby creating pressure differential between the conduits causing the piston to move in an opposite direction. The piston is provided with permanent magnet means spatially coupled to electrical coil means. When the piston reciprocates it creates a magnetic flux in the coil means, which is transformed into electric current.

The piston is disposed between a hot and a cold zone to provide a cycle engine. The cold zone condenses the hot discharged gas from the piston into a liquid and supplies the liquid to the hot zone. The hot zone transfers heat to the liquid to vaporize it into a high-pressure hot gas, which is supplied to the piston.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Cycle Engine Construction

Figure 1:
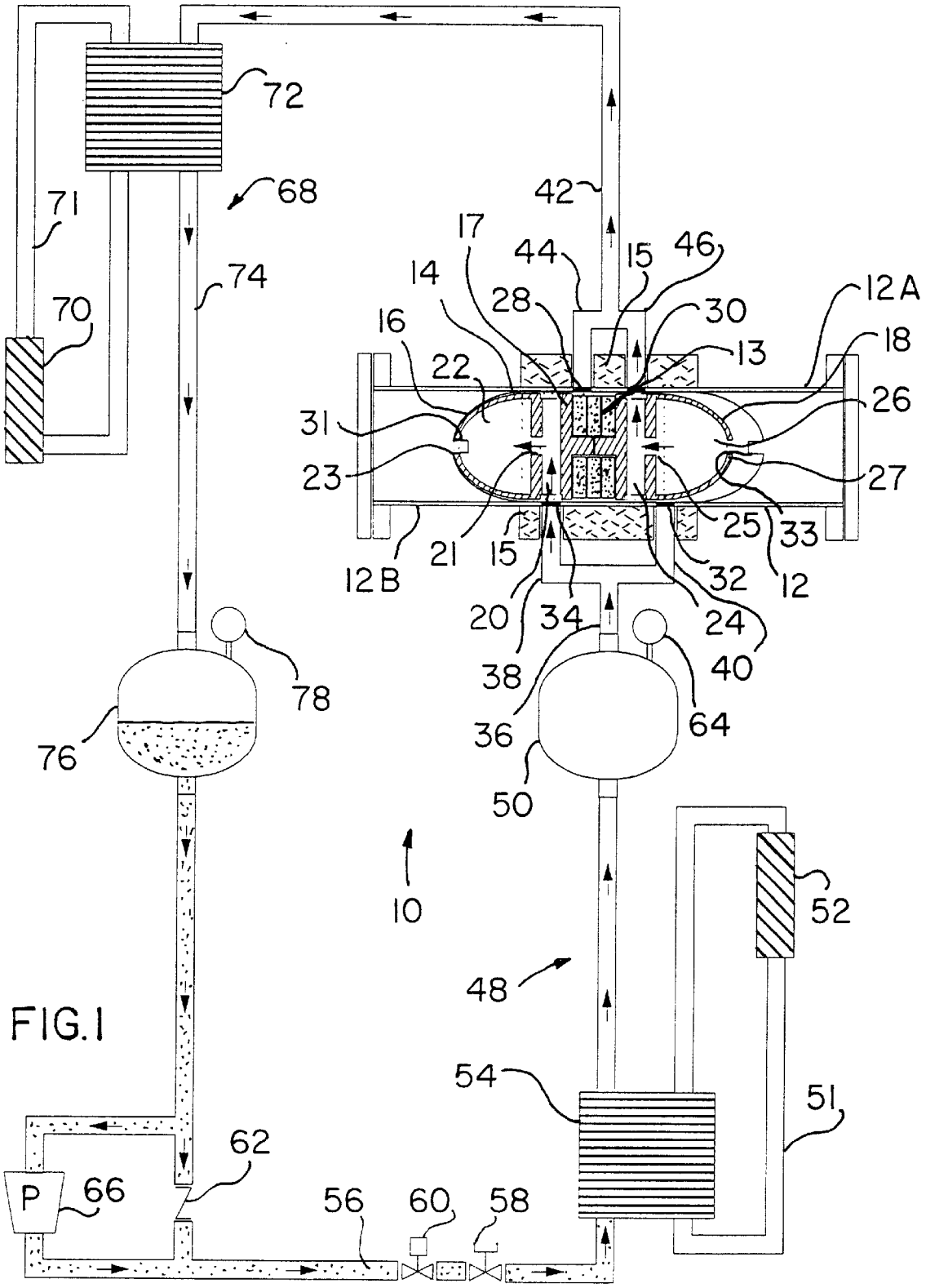
FIG. 1 is an end elevation of the cycle engine showing hot gas being supplied to the first piston head while gas being discharged from the second piston head.
Figure 2:
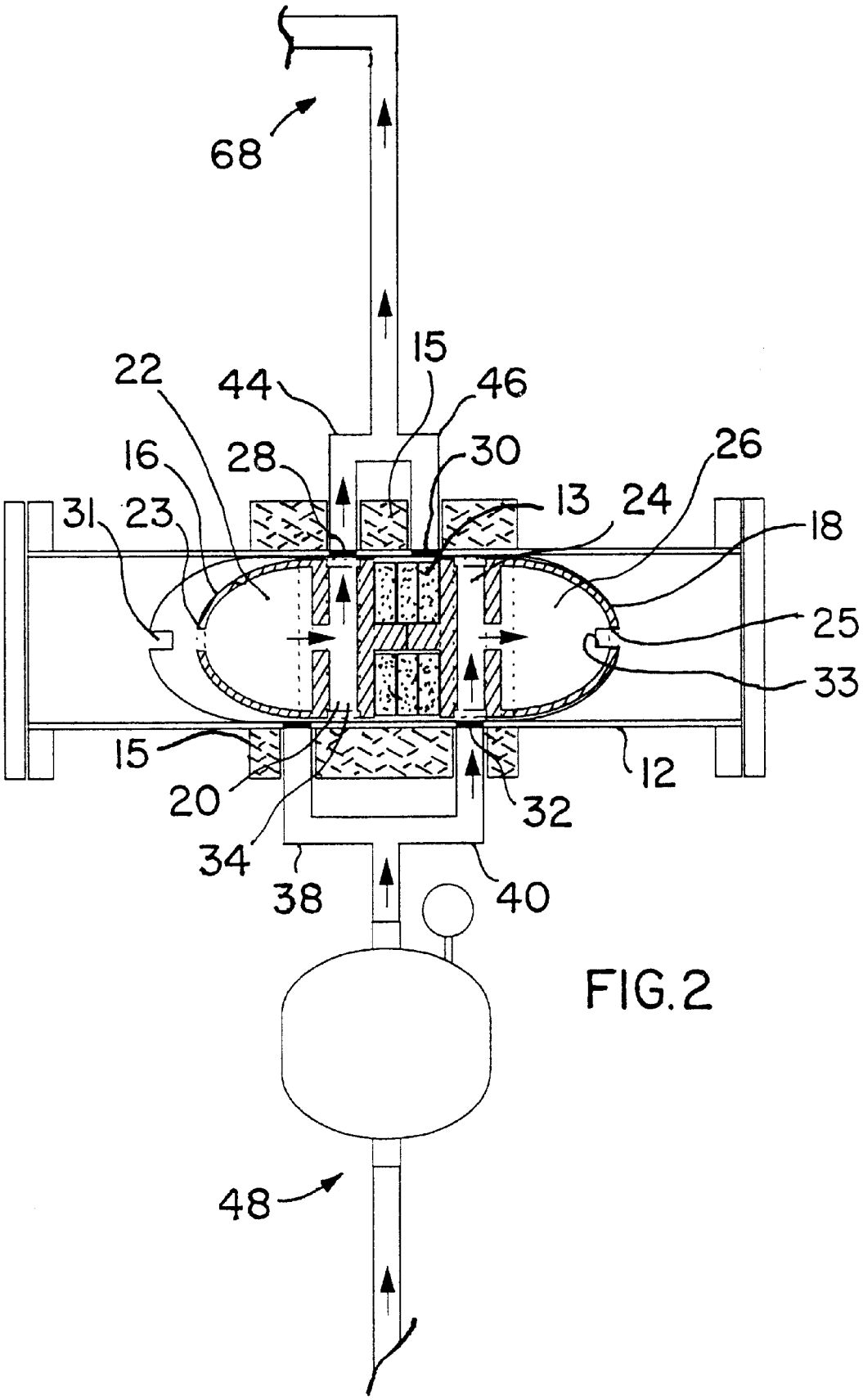
FIG. 2 is an elevation of the cycle engine showing hot gas being supplied to the second piston head while gas being discharged from the first piston head.

In FIG. 1 there is shown a cycle engine 10 disposed between a hot zone 48 and a cold zone 68. The cylinder 12 is preferably made of non-conductive stainless steel or any other suitable materials known for those skilled in the art. The cylinder 12 houses a piston 14, which has a shape substantially conforming to the cylinder 12. The piston 14 has at least two oppositely disposed heads. The first piston head 16 and the second piston head 18 are rigidly connected together. The first piston head 16 is separated from the second piston head 18. by a partition 17, which carries permanent magnets 13 coupled to electric circuit coil means 15. The first piston head 16 has a longitudinal first gas linking conduit 20 for passing gas through it and transferring gas into an ellipsoidal first expansion chamber 22. through an opening 21. The first expansion chamber 22 has an outlet 23 for assisting in decelerating reciprocation of piston 14 by allowing the hot gas to escape from the outlet 23. A protrusion 31 enters the outlet 23 to substantially close same to further assist in decelerating the piston 14. Likewise, the second piston head 18 has a second longitudinal gas linking conduit 24, which is communicating fluidly with an ellipsoidal second expansion chamber 26 through an opening 25. The second expansion chamber 26 has an outlet 27 for assisting in decelerating the piston 14 by passing hot gas from the outlet 23. A protrusion 33 enters the outlet 27 upon closure movement to further assist in decelerating the piston 14. The cylinder 12 has an upper surface 12A and a bottom surface 12B. The upper surface 12A has at least two spaced ports, a first gas port 28 and a second gas port 30, which are fluidly connected respectively with the gas discharging pipes 44 and 46 and thence to common pipe 42. The first gas discharging pipe 44 discharges gas from the first chamber 22 when the first longitudinal conduit 20 aligns with the pipe 44. The second gas discharging pipe 46 discharges gas from the second chamber 26 when the second conduit 24 aligns with the second pipe 46. The bottom surface 12B has at least two ports, a third port 32 and a fourth port 34, which are fluidly connected respectively with spaced gas supplying pipes 38 and 40 and thence to a common pipe 36. The first gas pipe 38 provides gas to the first linking conduit 20 and the first gas expansion chamber 22 through port 34 when the first conduit 20 aligns with the first pipe 38. The second supplying pipe 40 provides gas to the second linking conduit 24 and the second gas expansion chamber 26 through port 32 when the second conduit 24 aligns with the second pipe 40.

The linking conduits 20 and 24 are spatially disposed in operative relationships relative to each other so that when the gas supply pipe 36 supplies gas to the first linking conduit 20 and the first chamber 22, the second linking conduit 24 discharges gas from the second chamber 26 into gas discharge pipe 46 and into pipe 42. In particular, when the first supply pipe 3 8 provides gas to the first conduit 20, the second conduit 24 and chamber 26 discharge gas into the gas discharging pipe 46 via port 30. When the second gas supply pipe 40 provides gas to the second linking conduit 24 and the second chamber 26 via port 32, the first linking conduit 20 discharges gas from the first chamber 22 to the gas discharging pipe 44 via port 28. Those actions create a pressure differential between the first chamber 22 in the first piston head 16 and the second chamber 26 in the second piston head 18 that causes the piston to reciprocate back and forth.

One method off achieving the above arrangement is accomplished by spatially positioning the gas conduits 20 and 24, a predetermined distance from each other, which is less than the distance between the hot gas supplying pipes 38 and 40, and larger than the distance between the hot gas discharging pipes 44 and 46 so that there are always two open ports, one open; to receive a gas from a gas supply pipe into a gas expansion chamber and another port open to discharge hot gas from another gas expansion chamber to a gas discharge pipe.

The hot zone 48 supplies hot gas through the gas supply pipe 36, which is bifurcated into two pipes, a first gas supply pipe 38 and a second gas supply pipe 40. The first gas supply pipe 38 supplies hot gas to the first conduit 20 and the first gas expansion chamber 22 via the fourth port 34. The second gas supply pipe 40 provides hot gas to the second conduit 24 and the second gas expansion chamber 26 via the third port 32. The hot zone 48 receives condensed liquid through a fluid pipe 56. The liquid is pressurized by pressurizing means such as a high pressure liquid pump 66. The liquid travels through a heat exchanger 54 to contact heat current 51 flowing concurrently or counter-currently from a heat source 52, such as a solar collector well known in the art. As a result of the heat transfer, the liquid vaporizes and turns into a high pressure hot gas, which flows into a receiver 50. The receiver 50 releases hot gas into the hot gas supply pipe 36 when flowing into engine 10.

The cold zone 68 receives hot gas through a discharging pipe 42 from engine 10 via first gas discharging pipe 44 and second gas discharging pipe 46. The first gas discharging pipe 44 communicates fluidly with the first port 28, while the second gas discharging pipe 46 communicates fluidly with the second port 30. The gas discharging pipe 42 transports the hot gas into a heat exchanger 72. A cold source 70, which may be ambient air or a water cooled device, provides a cold fluid 71 flowing through the heat exchanger 72 to absorb heat from the hot gas and transforming the gas into a condensed liquid. The liquid flows through a pipe 74 to a low pressure receiver 76 for storing the liquid. The receiver 76 is provided with a pressure sensor 78. to control the pressure inside it. The liquid flows from the receiver 76 to high pressurizing means such as high pressure pump 66. The liquid is pressurized and sent to the hot zone 48 to complete the cycle.

Cycle Engine Operation

The engine reciprocates between one position and another position. In one position, a port 34 is open to receive hot gas from the gas supply pipe 38 into the first conduit 20 and the first gas expansion chamber 22. The port 30 opens to discharge any gas inside the second conduit 24 and the expansion chamber 26 into the gas discharge pipe 46. Hot gas moves inside the conduit 20 and into gas expansion chamber 22. After a period of time, a gas pressure differential builds up between the first gas expansion chamber 22 and the second expansion chamber 26 causing the piston 14 to move to one position. When the piston 14 moves, the gas supply pipe 40 align with the second conduit 24. The second conduit 24 and the second gas expansion chamber 26 receive hot gas via the port 32. The hot gas moves inside the second conduit 24 and into the gas second expansion chamber 26. Pressure increases inside the second expansion chamber 26. Simultaneously, the first conduit 20 aligns with the gas discharging pipe 44 and the port 28 discharges gas from the first gas expansion chamber 22 into the pipe 44, thereby reducing gas pressure inside the first gas expansion chamber 22. A pressure differential between the first gas expansion chamber 22 and the second gas expansion chamber 26 builds up causing the piston 14 to move to another position. The discharged gas moves into a heat exchanger 72 to exchange heat with a cold current 71 flowing from a cold source 70. The heat exchange transforms the hot gas into a condensed liquid that flows into a pipe 74 and then into a high pressurized means, such as a pump 66 through receiver 76. The pump 66 pressurizes the liquid and pumps it into heat exchanger 54 via fluid pipe 56. The liquid exchanges heat with a hot current 51 flowing from a hot source 52 and evaporates to a high pressure hot gas. The hot gas is fed to the gas supply pipe 36 to pipes 38 and 40 and then into the first conduit 20 and the first gas expansion chamber 22. Simultaneously, the hot gas is discharged from the second gas expansion chamber 26 though the second conduit 24 to the pipe 46 via port 30. This action causes a pressure differential between the first gas expansion chamber 22 and the second gas expansion chamber 26 causing the piston 14 to move to one position. When the second conduit 24 aligns with the pipe 40, hot gas flows form the pipe 40 via the port 32 into the second conduit 24 and the second gas expansion chamber 26. Simultaneously, the first conduit 20 aligns with the pipes 44 to exhaust hot gas from the first gas expansion chamber 22 through the first conduit 20 to the pipe 44 via the port 28. The piston 14 is provided with a magnet 13 coupled to electrical circuit means 15. The reciprocation of piston 14 from one position to another creates a magnetic flux in the coil means 15, which is transformed into electricity.

While the invention has been described with respect to certain specific embodiments, it will be appreciated that many modifications and changes may be made by those skilled in the art without departing from the spirit of the invention. It is intended, therefore, by the appended claims to cover all such modifications and changes as they fall within the true spirit and scope of the invention.

What is claimed as new and what is desired to secure by Letters Patent of the United States is:

1. A cycle engine for converting thermal energy to electrical energy comprising an elongated cylinder housing a piston disposed between a hot zone and a cold zone and having a surface communicating fluidly with said hot zone to receive hot gas and another surface communicating fluidly with said cold zone to discharge gas to said cold zone, said housing having opposite end portions, said piston having first and second oppositely disposed heads mounted for reciprocation in said housing, said piston being reciprocable between one position in which said first head receives hot gas from said hot zone and said second head exhausts hot gas to said cold zone, and another position in which said second head receives hot gas from said hot zone and said first head discharges hot gas to said cold zone, said piston carrying at least one permanent magnet and stationary coil means outwardly of said cylinder coupled to said at least one permanent magnet to generate electricity in said coil means when said piston reciprocates.

2. The cycle engine of claim 1 in which in said one position said first head having a first conduit transferring hot gas into said first head, a first expansion chamber fluidly communicating with said first conduit receiving hot gas to increase gas pressure inside said chamber, said second head having a second conduit, a second expansion chamber fluidly connected to said second conduit discharging gas from said second chamber to decrease gas pressure in said second chamber thereby creating pressure differential between said first and second heads causing said piston to move in one direction.

3. The cycle engine of claim 1 in which in said another position said first conduit discharges hot gas from said first expansion chamber to decrease gas pressure inside said chamber, and said second conduit transfers hot gas into said second expansion chamber to increase gas pressure inside said second chamber thereby creating pressure differential between said first and second heads causing said piston to move in another direction opposite from said one direction.

4. The cycle engine of claim 1 wherein each of said gas chambers includes an expansion outlet for assisting in decelerating reciprocation of each of said pistons within said cylinder by discharging pressurized gas through said outlets, each of said end portions of said cylinder having a protrusion to close said outlet upon full stroke of said piston to further assist in decelerating said pistons in said cylinder during reciprocating movement of said pistons.

5. The cycle engine of claim 1 wherein said cold zone includes a coolant supply, a heat exchanger fluidly connected to said coolant supply to transfer heat from said discharged gas to said coolant to condense said gas into a liquid.

6. The cycle engine of claim 1 wherein said cold zone further including a low pressure receiver, to store said condenser liquid.

7. The cycle engine of claim 1 wherein said hot zone further includes a hot source, a heat exchanger fluidly connected to said source, means for pressurizing said condenser, said means being fluidly connected to said heat exchanger, said heat exchanger transfers heat from said heat source to said pressurized condenser to vaporize said condenser.

8. The cycle engine of claim 2 wherein said hot zone further includes a pressurized gas receiver to store hot gas and being fluidly connected to said at least two pipes for supplying hot, gas to said first and second gas conduits.

9. A cycle engine for converting thermal to electrical energy comprising a housing disposed between a hot zone supplying hot gas to said housing and a cold zone receiving discharged gas from said housing and having one surface having spatially distanced first and second gas ports, another surface having spatially distanced third and fourth gas ports, said housing having an elongated cylinder having opposite end portions, a piston mounted for reciprocation in said cylinder between one position and another position, said piston having first and second opposite heads, wherein in said one position said hot zone provides hot gas to said first head through said third port while said second port discharges gas from said second head to said cold zone, and wherein in said another position said hot zone provides gas to second head through said fourth port while said first port discharges gas from said first head to said cold zone, a magnet mounted for movement with and on said piston, an electrical coil means coupled to said magnet and disposed outwardly of said housing to generate electricity in said coil means when said piston reciprocates.

10. The cycle engine of claim 9 wherein said first head includes a first gas expansion chamber, a first gas conduit communicating fluidly with said first gas chamber, and said second head includes a second gas expansion chamber, a second gas conduit communicating fluidly with said second gas chamber.

11. The cycle engine of claim 9 wherein in said one position said first conduit aligns with said third port to transfer hot gas into said first gas chamber to increase gas pressure inside said chamber, said second conduit aligns with said second port to discharge gas to said cold zone, thereby creating pressure differential between said heads causing said pistons to move in one direction.

12. The cycle engine of claim 9 wherein in said another position said second conduit aligns with said fourth port to receive hot gas from said hot zone to transfer gas into said second gas chamber to increase gas pressure inside said chamber, said first conduit aligns with said first port to discharge gas into said cold zone to decrease gas pressure inside said first gas chamber, thereby creating pressure differential between said heads causing said pistons to move in said another direction.

13. The cycle engine of claim 9 wherein said first, second gas conduits, first, second, third, and fourth ports are disposed relative to each other so that when said first conduit aligns with said fourth port, said second conduit aligns with said second port, and when said first conduit aligns with said first port, said second conduit aligns with said third port.

14. The cycle engine of claim 9 wherein said first, second gas conduits, first, second, third and fourth ports are disposed in an operative relationship so that diagonally opposed ports are simultaneously both open or closed.

15. The cycle engine of claim 9 wherein said first and second gas ports being spatially distanced from each other less than said distance between said third and fourth ports, and said first gas conduit being distanced from said second gas conduit larger than said distance between said first and second gas ports and less than said distance between said third and fourth ports.

16. The cycle engine of claim 9 wherein said first and second gas ports being spatially distanced from each other larger than said distance between said third and fourth ports, and said first gas conduit being distanced from said second gas conduit less than said distance between said first and second gas ports and larger than said distance between said third and fourth ports.

17. The cycle engine of claim 9 wherein said hot zone further including at least two pipes, one of said pipes aligns with said fourth ports and said other pipe aligns with said third port for supplying heated gas to said first and second gas conduits.

18. The cycle engine of claim 9 wherein said hot zone further including a pressurized gas receiver to store hot gas and being fluidly connected to said at least two pipes for supplying hot gas to said first and second gas conduits.

19. A method for converting thermal to electrical energy comprising the steps of:

A. introducing hot gas into a first piston head, the first head being rigidly connected to an oppositely disposed second piston head, the pistons carrying a permanent magnet means coupled to electric coil means outwardly disposed of an elongated housing in which the pistons are slidably movable for reciprocation in the elongated cylinder housing;

B. discharging hot gas from the second head thereby creating a pressure differential between the heads causing the piston heads to move in one direction;

C. introducing hot gas into the second head; and

D. discharging hot gas from the first head thereby creating pressure differential between the heads causing the piston heads to move in another direction opposite to the one direction thereby generating electricity in said electrical coil means.

20. The method of claim 19 wherein step A further includes the step of aligning a first gas conduit in the first head with a hot gas supply pipe, the first gas conduit communicating fluidly with a first gas expansion chamber within the first head.

21. The method of claim 19 wherein step B further includes the step of aligning a second gas conduit in the second head with a gas discharging pipe, the second gas conduit communicating fluidly with a second expansion gas chamber within the second head.

22. The method of claim 19 wherein step C further includes the step of aligning the second gas conduit with another hot gas supply pipe.

23. The method of claim 19 wherein step D further includes the step of aligning the first gas conduit with another gas discharging pipe.

24. The method of claim 19 wherein steps A and C include the step of solar generating hot gas.

25. The method of claim 24 wherein the step of solar generating hot gas includes the step of transferring heat generated to a condensed liquid from a hot source to vaporize the liquid into a high pressure hot gas.

26. The method of claim 19 wherein steps B and D further include the step of transforming the discharged hot gas into a condensed liquid.

27. The method of claim 26 wherein the step of transforming gas into a liquid includes the step of heat exchanging the hot gas with a cold source.

28. The method of claim 19 further including the step of creating a cushion between each of the piston heads and an opposite cylinder end portion enabling frictionless movement of the piston heads between the end portions of the cylinder.

29. The method of claim 28 wherein the step of cushioning each of the piston heads include the step of leaking gas from an outlet at an end of each of the piston heads to sandwich leaking gas between each of the piston heads and the opposite end portion of the cylinder.

30. The method of claim 29 wherein the step of cushioning each of the piston heads further includes the step of entrapping the leaking gas between each of the piston heads and a protrusion disposed at each of the end portions of the cylinder.

31. A method for converting thermal to electrical energy comprising the steps of:

a. providing a continuous cycle having a hot zone for generating hot gas and a cold zone for condensing the hot gas into a liquid;

b. introducing hot gas into a first head of double oppositely headed piston disposed between the hot and cold zones, the piston being mounted for reciprocation in a cylinder of a housing having opposed surfaces, one surface having two spatially distanced gas discharging conduits communicating fluidly with the cold zone, another surface having two spatially distanced conduits for supplying hot gas from the hot zone, the first head having a first gas linking conduit, a first gas expansion cavity communicating fluidly with the first linking conduit, the second head having a second gas linking conduit, a second gas expansion cavity communicating fluidly with the second linking conduit, the piston carrying a magnet coupled to electrical coil means disposed outwardly of the housing;

c. discharging gas from the second linking conduit into one of the two discharging gas ports thereby creating a pressure differential between the heads causing the piston heads to move in one direction;

d. introducing hot gas into the second head; and e. discharging hot gas from the first linking conduit thereby creating pressure differential between the heads causing the piston heads to move in another direction opposite to the one direction thereby generating electricity in the electrical coil means.

32. The method of claim 31 wherein step B includes the step of introducing hot gas from the hot zone into the first linking conduit.

33. The method of claim 31 wherein step D includes introducing hot gas into the second linking conduit.

* * * * *